US006233903B1

(12) United States Patent
Ide

(10) Patent No.: US 6,233,903 B1
(45) Date of Patent: May 22, 2001

(54) PACKING FILM FEEDER FOR MULTIPLE AUTOMATIC PACKING MACHINE

(75) Inventor: Shoichi Ide, Sagamihara (JP)

(73) Assignee: Sanko Machinery Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/296,498

(22) Filed: Apr. 22, 1999

(30) Foreign Application Priority Data

Jun. 26, 1998 (JP) ..... 10-196669

(51) Int. Cl.[7] ..... B65B 9/20; B65B 61/06

(52) U.S. Cl. ..... 53/141; 53/202; 53/546; 53/551; 53/389.2

(58) Field of Search ..... 53/202, 546, 550, 53/551, 389.2, 141; 493/302

(56) References Cited

U.S. PATENT DOCUMENTS

| | | | | |
|---|---|---|---|---|
| 2,918,769 | * | 12/1959 | Anderson | 53/546 |
| 3,026,658 | * | 3/1962 | Schneider | 53/389.2 |
| 3,451,187 | * | 6/1969 | Massey | 53/546 |
| 4,299,075 | * | 11/1981 | Gram | 53/546 |
| 4,448,010 | * | 5/1984 | Stohiquist | 53/546 |
| 5,408,807 | | 4/1995 | Lane, Jr. et al. . | |
| 5,634,324 | | 6/1997 | Schmactel . | |
| 5,822,949 | * | 10/1998 | Naoi | 53/546 |

* cited by examiner

*Primary Examiner*—John Sipos

(74) *Attorney, Agent, or Firm*—Stevens, Davis, Miller & Mosher, LLP

(57) ABSTRACT

In a multiple automatic packing machine comprising a slitter for slitting a wide sheet-like packing material supplied from a take-up roll into a plurality of packing films, a heat sealing device for seal molding each of the packing films into an elongated bag-like configuration by a vertical heat sealer and a lateral heat sealer, and a material filling device for filling a material to be packed into each of the packing films which has been seal molded into an elongated bag-like configuration through a feed pipe with a filling screw disposed therein which screw is rotatable by a motor, the slitting, heat sealing and material filling operations being repeatedly performed in a consecutive manner by the slitter, heat sealing device and material filling device, respectively, thereby a plurality of stick-like packing products are seal molded at a time automatically and in a consecutive manner, a packing film feeder for the multiple automatic packing machine being characterized in that the feed pipes constituting the material filling device is preliminarily spacedly arranged in side by side relationship so that the motors for rotating the screws will not interfere with each other, a packing material feed portion comprising the take-up roll and the slitter is disposed at a different angle in a lateral direction with respect to an automatic packing portion comprising the material filling device and the heat sealing device, and each of the packing films which has been slit by the slitter and conveyed is trained over a plurality of direction-changing rollers arranged in side by side relationship in a slightly shifted manner in a conveying direction, thereby each of the packing films is changed in direction towards and fed to the automatic packing portion.

6 Claims, 2 Drawing Sheets

PACKING FILM FEEDER FOR MULTIPLE AUTOMATIC PACKING MACHINE

BACKGROUND OF THE INVENTION

This invention belongs to a technical field of multiple automatic packing machines capable of automatically seal-molding a plurality of stick-like packing products at a time, and particularly, it relates to a packing film feeder suited to be used for such a multiple automatic packing machine.

As disclosed for example in U.S. Pat. Nos. 5,634,324, 5,408,807, etc., the conventional multiple automatic packing machine is constructed such that operations of slitting, vertical sealing, lateral sealing, filling of material to be packed and cutting are carried out with respect to rolls of packing material formed from a uniformly printed wide sheet film in accordance with the number of row.

The construction of the above conventional multiple automatic packing machine will be described in detail with reference to FIG. 3. Reference character F denotes a take-up roll with a printed wide packing material taken up thereon, AS, AT denote packing material supply rollers rotatable by a motor (not shown), BX . . . denote slitters for slitting the packing material FX into a plurality of packing films Fa . . . , and Ca, Cb denote guide rollers.

Similarly, reference character D . . . denote feed pipes for filling material to be packed laterally equally spacedly disposed in side by side relationship, E . . . denote forming members for forming incoming packing films Fa . . . around the feed pipes D . . . , X denotes a vertical heat sealer for vertically sealing opposite end edges of the respective packing films Fa . . . into a sleeve-shape as a whole, and Y denotes a lateral heat sealer for applying a lateral seal to the vertically sealed sleeve-like packing films Fa . . . When this lateral heat sealer Y performs a lateral sealing, the material to be packed is filled into each of the packing films Fa . . . which has been seal molded into a bag-like configuration through each of the feed pipes D . . . Then, the lateral heat sealer Y performing a lateral sealing to each of the packing films Fa . . . is moved downwardly by one pack portion to withdraw each of the packing films Fa . . . by one pack portion.

Thereafter, the lateral heat sealer Y is laterally opened to release a lateral sealing and in that state, it is raised back to a position ready to perform a lateral sealing. In that position, the lateral heat sealer Y performs a lateral sealing once again to tightly seal a mouth of each sealed bag filled with the material to be packed and a cutter (not shown) vertically cuts a center line portion of the lateral sealing. By this, one cycle of multiple sealing operations is completed.

In FIG. 3, reference character TN denotes a hopper containing a material to be packed, Da . . . denote upper end inlet ports of the feed pipes D . . . inserted into a bottom portion Ta of this hopper TN, Ma . . . denote rotary shafts whose lower end portions are inserted into the feed pipes D from the inlet ports Da . . . , Ms . . . denote material filling screws formed on lower end portions of the rotary shafts Ma . . . inserted into the feed pipes D . . . , and HP generally denotes an automatic packing portion including the heat sealers X, Y.

Similarly, reference character M . . . denote motors for rotating the rotary shafts Ma . . . disposed on an upper surface portion of the hopper TN. When the screw Ms is rotated within the feed pipe D, the material to be packed contained in the hopper TN is taken into the feed pipe D through the inlet port Da. Then, the material to be packed is smoothly an forcibly filled into the packing film Fa which has been seal molded into a bag-like configuration through the feed pipe D having a small diameter. Even a material to be packed, which is in the form of powder or in a viscous state, can be supplied under compression in an extremely stable manner by rotation of the screw Ms.

In FIGS. 2 and 3, reference characters P . . . denote packed products each of which has been seal molded into a stick-like configuration by the multiple automatic packing machine, Pa . . . denote vertical seal portion, and Pc, Pb denote upper and lower lateral seal portions cutting into two by a cutter.

As mentioned above, according to the conventional multiple automatic packing machine of FIG. 3, a number of stick-like packing products P . . . can be packed automatically at a time. However, there is a need of providing rotational drive motors M . . . on the upper end portions of the respective rotary shafts Ma . . . in order to rotate the screw Ms for filling a material to be packed into each feed pipe D and in addition, there is a need of enlarging a distance between each adjacent rotary shafts Ma . . . , i.e., a distance between each adjacent feed pipes D . . . so that the motor M . . . will not interfere with each other. The enlargement of the distance gives rise to the problems to be described hereinafter.

Since the packing films Fa . . . , which have been slit by the slitters Bx . . . , are advanced straight ahead, they cannot be directly delivered to and form around the feed pipes D . . . which are arranged side by side relationship at an enlarged distance therebetween as mentioned above. Eventually, it becomes necessary to forcibly enlarge the distance between each adjacent feed pipes D . . . of the filling device in a lateral direction in such a manner to coincide with the distance Fb between each adjacent packing films Fa . . . as shown in FIG. 3. As a consequence, the packing film Fa is degraded in quality by traces of wrinkles and folds, thus resulting in poor final products.

SUMMARY OF TIE INVENTION

It is, therefore, an object of the present invention to provide a packing film feeder for a multiple automatic packing machine in which when an elongated stick-like packing product is seal molded by slitting a wide sheet-like packing material into a plurality of packing films and then delivering them into an automatic packing portion, the packing films, which have been slit, can be directly straightly fed into the automatic packing portion without a need of forcibly enlarging the distance between each adjacent packing films in conformity with the distance between each adjacent material filling device.

In order to achieve the above object, there is essentially provided in a multiple automatic packing machine comprising slitter means for slitting a wide sheet-like packing material supplied from a take-up roll into a plurality of packing films, heat sealing means for seal molding each of the packing films into an elongated bag-like configuration by a vertical heat sealer and a lateral heat sealer, and material filling means for filling a material to be packed into each of the packing films which has been seal molded into an elongated bag-like configuration through a feed pipe with a filling screw disposed therein which screw is rotatable by a motor, the slitting, heat sealing and material filling operations being repeatedly performed in a consecutive manner by the slitter means, heat sealing means and material filling means, respectively, thereby a plurality of stick-like packing products are seal molded at a time automatically and in a consecutive manner, (1) the feed pipes constituting the material filling means is preliminarily spacedly arranged in side by side relationship so that the motors for rotating the screws will not interfere with each other, a packing material feed portion comprising the take-up roll and the slitter means is disposed at a different angle in a lateral direction with respect to an automatic packing portion comprising the material filling means and the heat sealing means, and each of the packing films which has been slit by the slitter means and conveyed is trained over a plurality of direction-changing rollers arranged in side by side relationship in a slightly shifted manner in a conveying direction, thereby each of the packing films is changed in direction towards and fed to the automatic packing portion (claim 1), (2) the direction-changing rollers are each shifted in the conveying direction of the packing films by a distance equal to a distance between each adjacent feed pipes so that a distance between each adjacent packing films trained over the direction-changing rollers is coincident with a distance between each adjacent feed pipes of the material filling means arranged in side by side relationship at the automatic packing portion (claim 2), (3) the packing material feed portion is disposed at a different angle of about 90 degrees in a lateral direction with respect to the automatic packing portion and the direction-changing rollers over which the packing films are trained are each slanted by about 45 degrees with respect to the conveying direction of the packing films.

According to the features of above (1) as defined in claim 1, when each of the packing films, which have been slit by the slitters, is trained over the direction-changing rollers and changed in direction towards the automatic packing portion, the distance-changing rollers are slightly shifted in the conveying direction and therefore, the distance between each adjacent packing films is not required to be forcibly enlarged in a lateral direction. Accordingly, the packing films, which have been slit, can be directly straightly fed into the automatic packing portion without a need of forcibly enlarging the distance. This allows to enlarge the distance between each adjacent packing films in conformity with the distance between each adjacent feed pipes of the material filling means in a natural manner. Thus, there can be seal molded a stick-like packed product of high merchandise value without traces of wrinkles and folds.

According to the features of the above (2) as defined in claim 2, since the distance between each adjacent packing films can be enlarged in such a manner as to coincide with the distance between each adjacent feed pipes forming the material filling means of the automatic packing portion when the packing films are trained over the direction-changing rollers, the packing films can be delivered into the automatic packing portion in their perfectly straightly advancing condition. Thus, there can be seal molded a stick-like packed product of high merchandise value without traces of wrinkles and folds.

According to the features of the above (3) as defined in claim 3, since the installing angle of the automatic packing portion is set to generally right angles with respect to the packing material feed portion and the packing films fed from the packing material feed portion are trained over the direction-changing rollers which are slanted by about 45 degrees so as to change in direction, it is possible that the packing films are changed in direction by generally right angles with a sufficient distance kept between each adjacent packing films and advanced straight towards the automatic packing portion for seal molding.

As discussed above, the above object of the present invention can be achieved by the above-mentioned features (1) to (3), overcoming the problems inherent in the prior art.

DETAILED DESCRIPTION OF THE INVENTION

One embodiment of a film feeder for a multiple automatic packing machine according to the present invention will now be described in detail with reference to the accompanying drawings.

Figure 1:
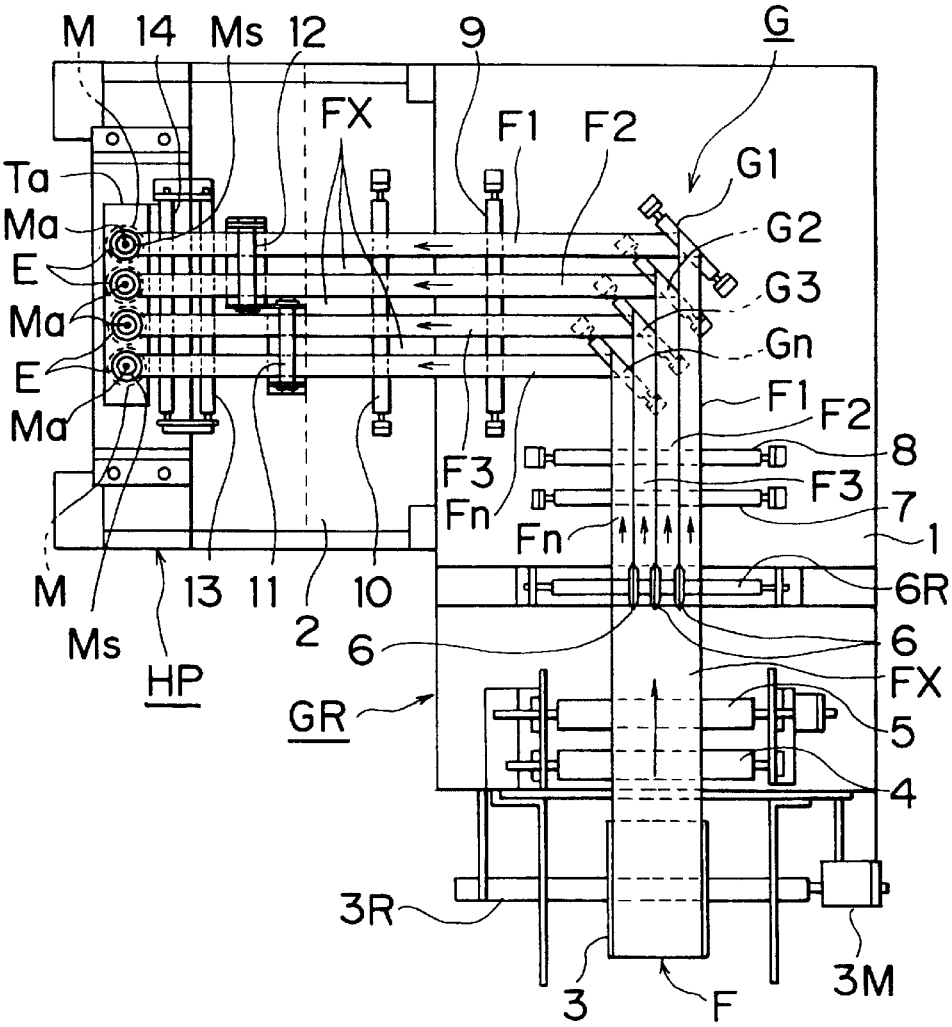
FIG. 1 is a plan view for explaining a construction of a multiple automatic packing machine equipped with a film feeder according to the present invention.
Figure 2:
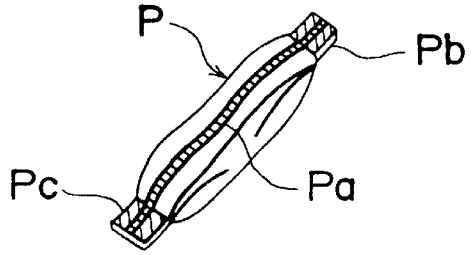
FIG. 2 is a perspective view of a stick-like packed product which is seal molded by the multiple automatic packing machine incorporated with the present invention.

FIG. 1 is a plan view for explaining a construction of the present invention. In FIG. 1, reference numeral 1 denotes a table on which a packing material feed portion, generally denoted by reference character GR, placed, and reference numeral 2 denotes a machine body on which an automatic packing portion, likewise generally denoted by reference character HP, is placed. The table 1 and the machine body 2 are connectively located such that the automatic packing portion HR is disposed at a different angle by 90 degrees in a lateral direction with respect to the packing material feed portion GR, The packing material feed portion GR includes a take-up roll F with a rolls of printed wide packing material FX, a roll pin 3R for supporting the roll F, a motor 3M for rotating the roll F, rollers 4, 5 for supplying packing material, a plurality of slitters 6 . . . for slitting the wide packing material FX into a plurality of packing films F1, F2, F3, Fn, a slitter rotary shaft on which the slitters 6 . . . are mounted, and guide rollers 7, 8 for guiding the conveyance of the packing films Fa to Fn.

Figure 3:
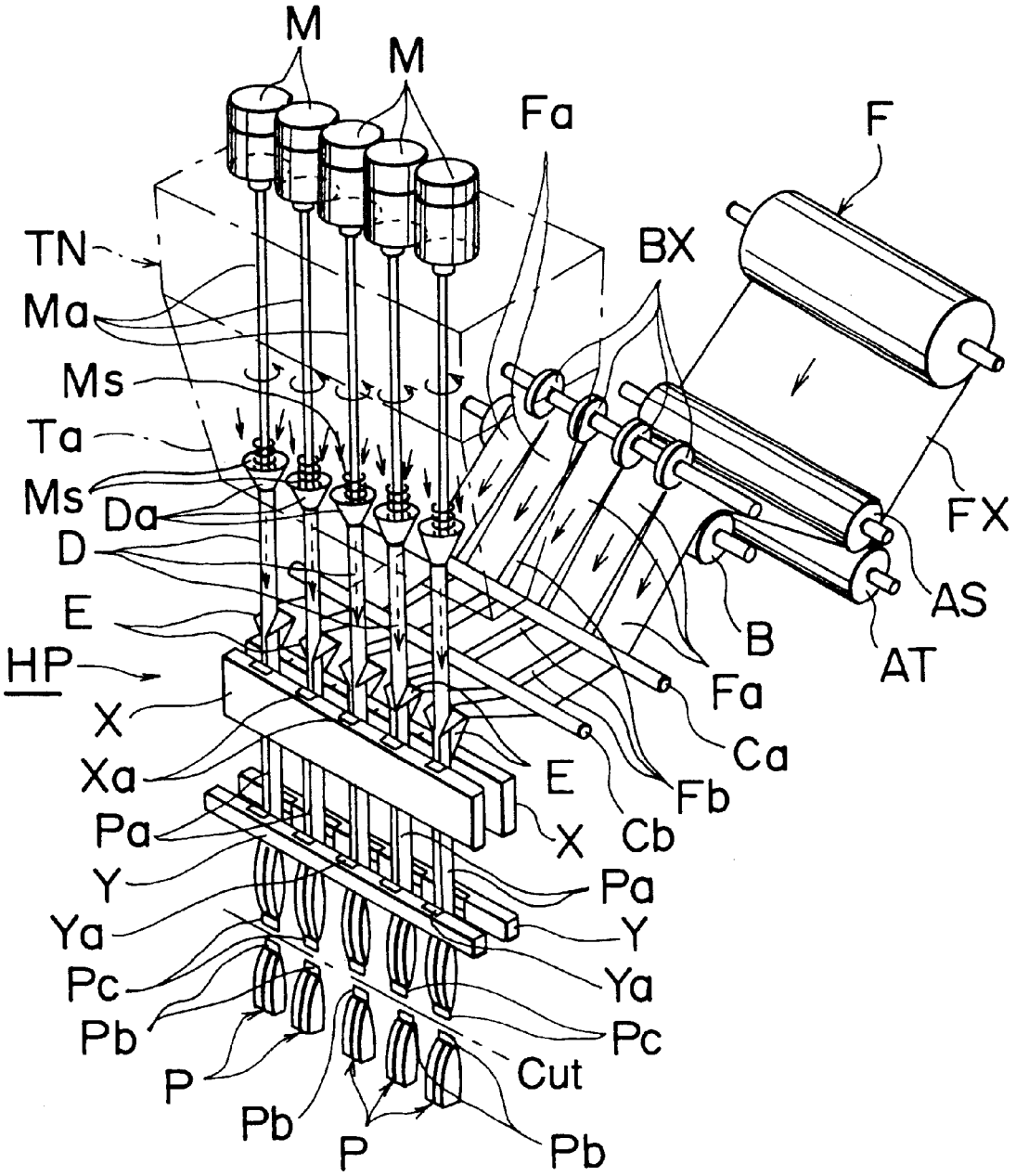
FIG. 3 is a perspective view for explaining a construction of the conventional multiple automatic packing machine.

The automatic packing portion HP includes guide rollers 9, 10, 11, 12, 13, 14 for guiding the conveyance of the packing films F1 to Fn which have been changed in direction of conveyance by a direction-changing device as later described, and the various members for use of multiple packing as previously described with reference to FIG. 3. However, FIG. 1 shows only forming members E . . . spacedly arranged in side by side relationship, rotary shafts Ma . . . , screws Ms . . . mounted on the rotary shafts Ma and adapted to fill material, motors M . . . for rotating the rotary shafts Ma . . . and a lower end portion Ta of a hopper for the sake of convenience. Since the remaining construction is same as in FIG. 3, illustration and description thereof are omitted.

In FIG. 1, reference character G generally denotes a direction-changing device disposed between the packing material feed portion GR and the automatic packing portion HP, specially on an upper surface of the table 1. This direction-changing device G includes a plurality of direction-changing rollers G1, G2, G3, Gn for changing the direction of the packing films F1 to Fn fed from the packing material feed portion GR by right angles and delivering them towards the automatic packing portion HP.

The direction-changing rollers G1 to Gn are arranged in side by side relationship on the upper surface of the table such that the direction-changing rollers G1 to Fn are each slanted by 45 degrees with respect to the conveying direction of the packing films F1–Fn and each shifted in the conveying direction of the packing films F1 to Fn by a distance equal to a distance between each adjacent feed pipes D enlarged by a provision of the motors M . . . so that a distance between each adjacent packing films F1 to Fn trained over the direction-changing rollers G1 to Gn is coincident with a distance between each adjacent feed pipes D . . . arranged in side by side relationship, thereby the packing films F1 to Fn can be changed in conveying direction by right angles towards the automatic packing portion HP.

Although FIG. 1 shows an arrangement in which the packing material feed portion GR is disposed at a different angle by 90 degrees with respect to the automatic packing portion HP and the direction-changing rollers G1 to Gn slanted by 45 degrees are arranged in side by side relationship therebetween, those angles are merely one example. In some cases, the packing material feed portion GR may be disposed at a different angle other than 90 degrees, such as any acute angles or obtuse angles. It is also accepted that the slanting angle of the direction-changing rollers G1 to Gn is varied to any other angles than 45 degrees in combination with the arrangement of the angular positional relationship between the packing material feed portion GR and the automatic packing portion HP.

Since the film feeder for a multiple automatic packing machine according to the present invention is constructed in such a manner as described hereinbefore, the packing films F1 to Fn having almost no space between each adjacent films as shown in FIG. 1 are trained over the direction-changing rollers G1 to Gn so that a distance FX . . . equal to that between each adjacent feed pipes D . . . is formed between each adjacent packing films F1 to Fn and delivered towards the automatic packing portion HP in that condition, it is not necessary to forcibly enlarge the distance (almost no distance) between the packing films F1 to Fn immediately after being slit in conformity with the distance between each adjacent feed pipes D . . . They can be fed to the forming members E . . . in their straightly advancing states and formed on the feed pipes D . . . in such a manner as to wrap up the feed pipes d . . .

As apparent from the foregoing, according to the film feeder for a multiple automatic packing machine according to the present invention, the packing films slit by the slitters can be fed directly to the automatic packing portion in their straightly advancing states. Therefore, there can be provided a stick-like packed product of high merchandise value with no traces of wrinkles and folds remained on the packing film.

What is claimed is:

1. A multiple automatic packing machine comprising:

slitter means for slitting a wide sheet-like packing material supplied from a take-up roll into a plurality of packing films;

multiple automatic packing portions with said multiple packing portions comprising (a) heat sealing means for seal molding each of said packing films into an elongated bag-like configuration with a vertical heat sealer and a lateral heat sealer, and (b) material filling means for filling a material into each of said elongated bag-like configurations, said material filling means comprising a feed pipe with a filling screw disposed therein which screw is rotatable by a motor;

wherein operations of said slitting means, said heat sealing means and said material filling means are repeatedly performed in a consecutive manner by said slitter means, said heat sealing means and said material filling means, respectively, whereby a plurality of packaged products are simultaneously seal molded automatically;

wherein a packing film feeder for said multiple automatic packing machine is characterized in that feed pipes of said material filling means are arranged side by side in a line so that said motors for rotating said filling screws will not interfere with each other, and wherein each of said packing films which has been slit by said slitter means is conveyed toward and trained over a plurality of staggered direction-changing rollers which are shifted relative each other in the direction of the incoming slit packing film and such that longitudinal axes of said direction-changing rollers are oriented in a slanted direction with respect to said incoming slit packing films, wherein each of said incoming slit packing films is changed in lateral direction relative to the direction of the incoming slit packaging film and fed to said automatic packing portion.

2. A multiple automatic packing machine according to claim 1, wherein said direction-changing rollers are staggered relative to each other at a distance equal to a distance between adjacent feed pipes, so that a distance between adjacent packing films leaving said direction-changing rollers is coincident with a distance between corresponding adjacent feed pipes.

3. A multiple automatic packing machine according to claim 1, wherein, in a plane defined by said incoming slit packing films, an approximately 90 degree angle is formed at the intersection of a line extending from said packing film feeder to said direction changing rollers and a line extending from said direction changing rollers to said multiple packing portions and said longitudinal axes of said direction-changing rollers are each slanted by about 45 degrees with respect to said incoming slit packing films.

4. A method of packaging products in a multiple automatic packing machine comprising multiple automatic packing portion for simultaneously seal molding a plurality of packaged products automatically, comprising:

consecutively and repeatedly slitting a wide sheet-like packing material supplied from a take-up roll into a plurality of packing films, seal molding each of said packing films into an elongated bag-like configuration with a vertical heat sealer and a lateral heat sealer, and filling a material into each of said bag-like configurations through a feed pipe, conveying each of said packing film which has been slit by said slitter means over a packing film feeder comprising of a plurality of staggered direction-changing rollers which are shifted relative each other in the direction of the incoming slit packing film and arranged such that longitudinal axes of said direction-changing rollers are oriented in a slanted direction with respect to said incoming slit packing films, wherein further, in a plane defined by said incoming slit packing films, the packing film feeder is disposed at a different lateral angle than said automatic packing portion wherein each of said incoming slit packing films is changed in lateral direction by said direction-changing rollers towards and fed to said automatic packing portion.

5. A multiple automatic packing machine according to claim 1, wherein first and second pluralities of said simultaneously seal molded packaged products are seal molded in a consecutive manner.

6. A method according to claim 4, wherein first and second pluralities of said simultaneously seal molded packaged products are seal molded in a consecutive manner.

* * * * *